US006219523B1

(12) United States Patent
Kobayashi

(10) Patent No.: US 6,219,523 B1
(45) Date of Patent: Apr. 17, 2001

(54) IMAGE FORMING APPARATUS AND DEVELOPING AGENT RECOVERY METHOD IN IMAGE FORMING APPARATUS

(75) Inventor: Yukie Kobayashi, Kanagawa-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/548,394

(22) Filed: Apr. 12, 2000

(51) Int. Cl.[7] ..... G03G 21/10
(52) U.S. Cl. ..... 399/358; 430/125
(58) Field of Search ..... 399/358, 349, 399/356, 357, 359, 360; 430/125

(56) References Cited

U.S. PATENT DOCUMENTS 4,891,679 * 1/1990 Saijo ..... 355/298
4,972,233 * 11/1990 Yamazaki et al. ..... 355/306
5,376,997 12/1994 Yamato et al. ..... 355/305
5,543,906 * 8/1996 Kanda ..... 355/299

FOREIGN PATENT DOCUMENTS 5-289594 11/1993 (JP) .

* cited by examiner

*Primary Examiner*—Richard Moses
(74) *Attorney, Agent, or Firm*—Foley & Lardner

(57) ABSTRACT

A peeling member for peeling magnetic waste toner scraped off from a photosensitive drum by a cleaning blade and conveyed to a waste toner recovery position by a magnetic developer carry-out roller is faced to the developer carry-out roller in a non-contact state. As waste toner on the developer carry-out roller is peeled off leaving a thin layer of waste toner in a thickness equivalent to the gap, a conveying amount of waste toner by the developer carry-out roller increases.

13 Claims, 4 Drawing Sheets

IMAGE FORMING APPARATUS AND DEVELOPING AGENT RECOVERY METHOD IN IMAGE FORMING APPARATUS

BACKGROUND OF THE INVENTION

1. Field of the Invention

The present invention relates to an image forming apparatus that recovers residual toner left on an image carrier after transferring a developer image on an image receiving medium and a developer recovery method in an image forming apparatus.

2. Description of the Related Art

A device using a magnetic roller as a cleaning means to remove and recover residual toner left on a photosensitive drum after transferring an image at an image forming apparatus of an electro-photographic system has been disclosed in Japanese Laid Open Patent No. 5-289594. However, for this cleaning means according to a magnetic brush roller, it is required to supply proper bias voltage between a photosensitive drum and the magnetic brush roller in order to get the good cleaning property.

On the other hand, there is an image forming apparatus using such a cleaning unit 1 as shown in FIG. 1 as a cleaning means to scrape off residual toner from the surface of a photosensitive drum with a cleaning blade.

The cleaning unit 1 has a carry-out paddle 6 made of a magnetic material for feeding waste toner scraped with a cleaning blade 3 to a recovery auger 4 that conveys waste toner toward a recovery box.

The cleaning unit 1 using this type of carry-out paddle 6, that is made of a magnetic material, has a film-shaped peeling member 7 that contacts a blade portion of the carry-out paddle 6 and peels off waste toner adhered to the carry-out paddle 6 to the recovery auger 4 side, and whenever the blade portion 6*a* of the carry-out paddle 6 is rotated, the peeling member 7 is brought in contact with tile blade portion 6*a* and peels waste toner therefrom.

Therefore, during the cleaning, the peeling member 7 is brought in contact with the blade portion 6*a* whenever the carry-out paddle 6 is rotated and the contacting sound and vibration tend to be produced and furthermore, the peeling member 7 is subject to the abrasion by the contact with the carry-out paddle 6

Therefore, for an image forming apparatus that is installed in an office and demanded to be kept in a calm and satisfactory environment, it is demanded to reduce noise and vibration of its cleaning unit as could as possible, and a cleaning unit capable of certainly feeding waste toner that is scraped with a cleaning blade to a recovery unit is demanded so that more higher cleaning effect can be obtained.

SUMMARY OF THE INVENTION

It is an object of the present invention to provide a calm and good environment without causing noises and vibrations around an image forming apparatus installed in an office, etc. without generating noises and vibrations.

Another object of the present invention is to maintain the high cleaning property by feeding waste toner scraped by a cleaning blade certainly to the recovery auger side up to the life end of the cleaning unit.

According to the present invention, an image forming apparatus comprising: image forming means for forming a developer image on an image carrier using magnetic developer; transferring means for transferring the developer image formed on the image carrier onto an image receiving medium; and cleaning means for scraping residual toner left on the image carrier into a container by a developer removing means after passing the transferring means, for conveying the scraped residual toner to the residual toner recovery position from the position facing the image carrier in the container by a developer carry-out means comprising a roller shaped magnetic member, and for peeling off the residual toner from the surface of the image carry-out means by a peeling means opposing to the developer carry-out means at the recovery position through a gap leaving a thin layer of the magnetic developer is provided.

Further, according to the present invention, a developer recovery method of an image forming apparatus comprising the steps of: a charging step for charging the surface of the image carrier to a prescribed potential; an exposing step for exposing and scanning the charged surface of the image carrier and forming an electrostatic latent image; a developing step for forming a developer image by feeding a magnetic developer to the electrostatic latent image formed on the surface of the image carrier; a transferring step for transferring the developer image formed on the image carrier on an image receiving medium; a scraping step for scraping residual developer left on the image carrier in a container after the transferring step is completed; a conveying step for conveying the residual developer scraped in the container to the residual developer recovery position from the position facing the image carrier by the magnetic developer carry-out roller in the container; and a peeling step for peeling the residual developer from the surface of the developer carry-out roller by a peeling means facing the developer carry-out roller through a gap at the recovery position leaving the thin layer of the magnetic developer is provided.

BRIEF DESCRIPTION OF THE DRAWINGS

Other features and benefits of the present invention will become clear by the following explanation referring to the attached drawings.

DETAILED DESCRIPTION OF THE PREFERRED EMBODIMENTS

Preferred embodiments of the present invention will be explained below in detail with reference to attached drawings.

Figure 1:
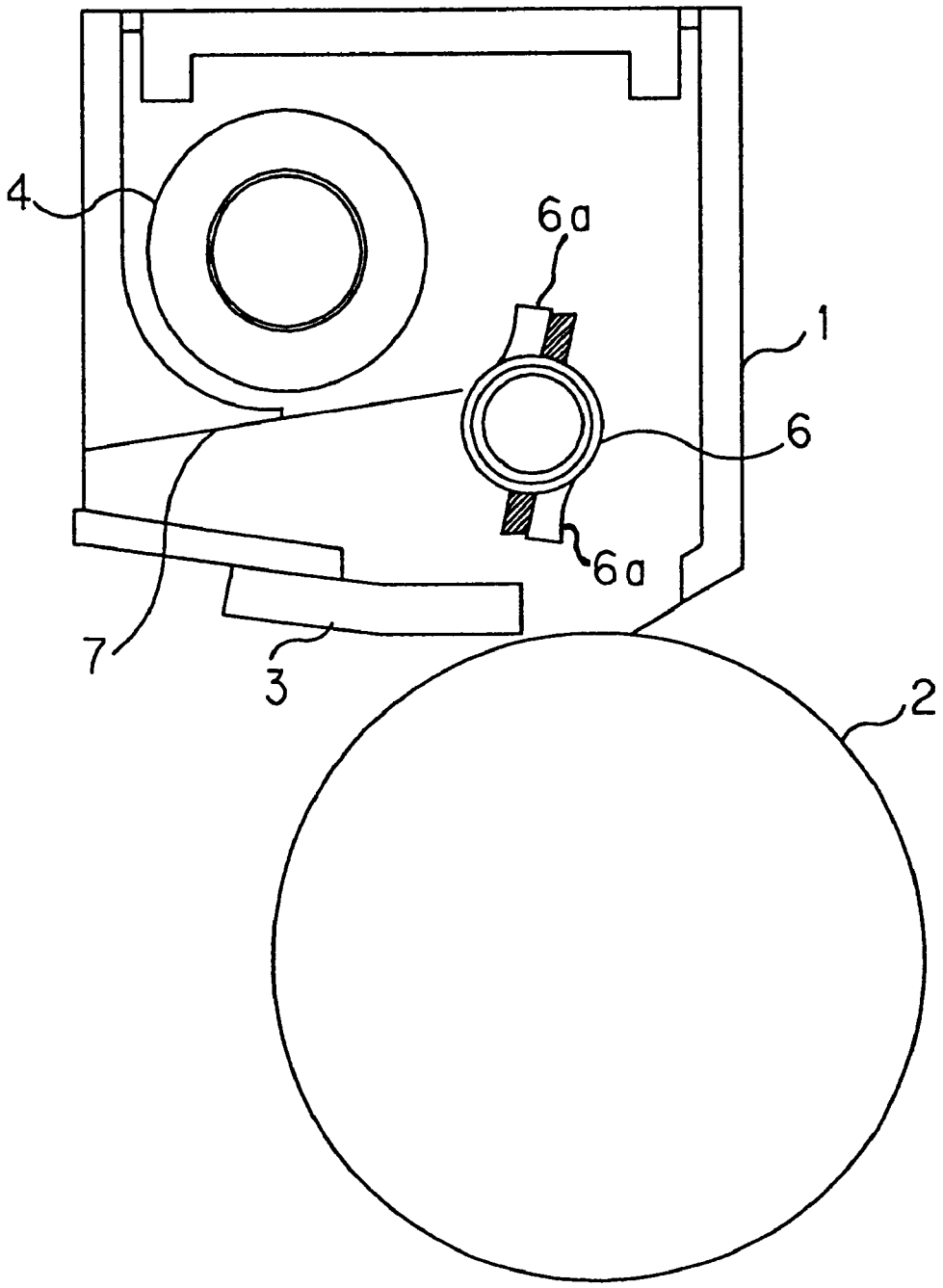
FIG. 1 (Related Art)
FIG. 1 is a schematic diagram showing a cleaning unit described in the Description of Related Art.
Figure 2:
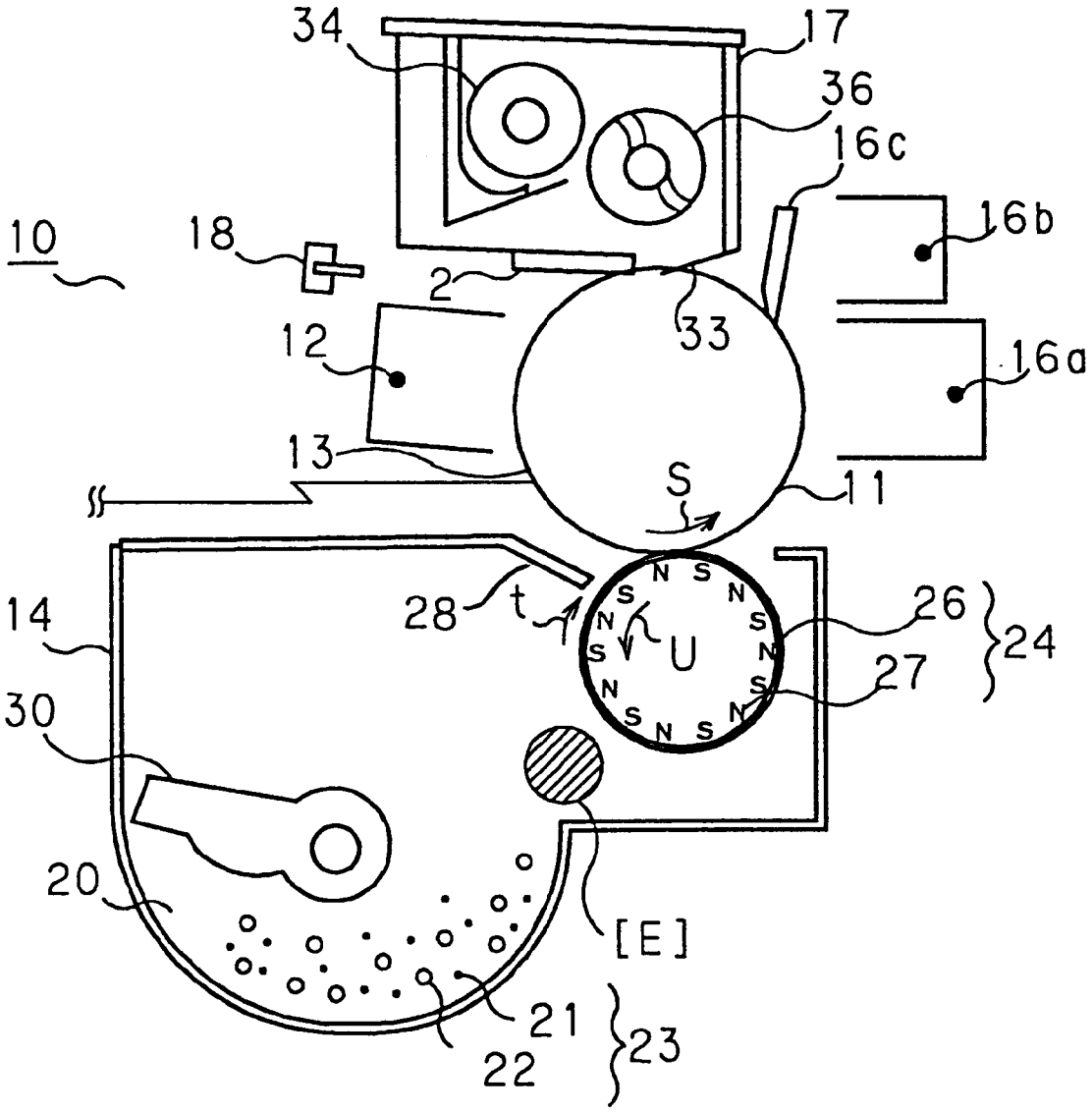
FIG. 2 is a schematic diagram showing an image forming unit of the image forming apparatus of the present invention.

FIG. 2 is a schematic diagram showing an image forming unit 10 of the electro-photographic image forming apparatus such as printers, copying machines, etc. relative to the present invention. A photosensitive drum 11 that is an image carrier is rotated in the arrow direction "s". Around the photosensitive drum 11, there are arranged an electrifying charger 12 that is a charging device, an exposing unit 13 of an exposure device, a developing device 14, a transferring charger 16*a* that is a transferring device, a peeling charger 16*c*, a paper peeling claw 16*c*, a cleaning unit 17 that is a cleaner, and a discharging lamp 18 along the rotating direction of the arrow "s".

Then, the developing device 14 will be described in detail. A developer containing unit 20 of the developing device 14 contains a developer 23 comprising magnetic toner 21 and carrier 22. At the position 20 facing the photosensitive drum 11 in the developer container unit 20, a developing roller 24 is provided.

The developing roller 24 has a magnet roller 27 having a number of magnetic poles and extending in the axial direction in a hollow cylindrical shaped developing sleeve 26 that is made of non-magnetic material. The developing sleeve 26 and the magnet roller 27 are provided coaxial and relatively rotatably. The developing sleeve 26 rotates in the arrow direction "t" and the magnet roller 27 rotated in the arrow direction "U".

As a result, the rotation of the developer 23 becomes the same as the conveying direction of the developer 23 and it becomes possible to increase conveying amount of developer and therefore, the developing can be made at a more high speed. Further, a non-magnetic developer control blade 28 is formed in the developer containing unit 20 and a stirrer 30 is provided almost at the center of the developer containing unit 20 to stir the developer 23 so as to prevent cohesion and supply the developer 23 to the developing roller 24.

In this developing unit 14, the developer 23 is stirred by the stirrer 30 and supplied to a developer magnetic absorbing area [E] around the developing roller 24.

The developer 23 supplied to the developer magnetic absorbing area [E] and magnetically absorbed is adsorbed on the developing sleeve 26 and stirred with the magnetic toner 21 by the rotation of the carrier 22 that rotates the magnet roller 27 that rotates relatively with the developer sleeve 26 and thus, the magnetic toner 21 is charged.

A ratio of weight of toner to weight of carrier 22 on the developing sleeve 26; that is, a specific density is maintained at, for instance, about 50%.

Figure 3:
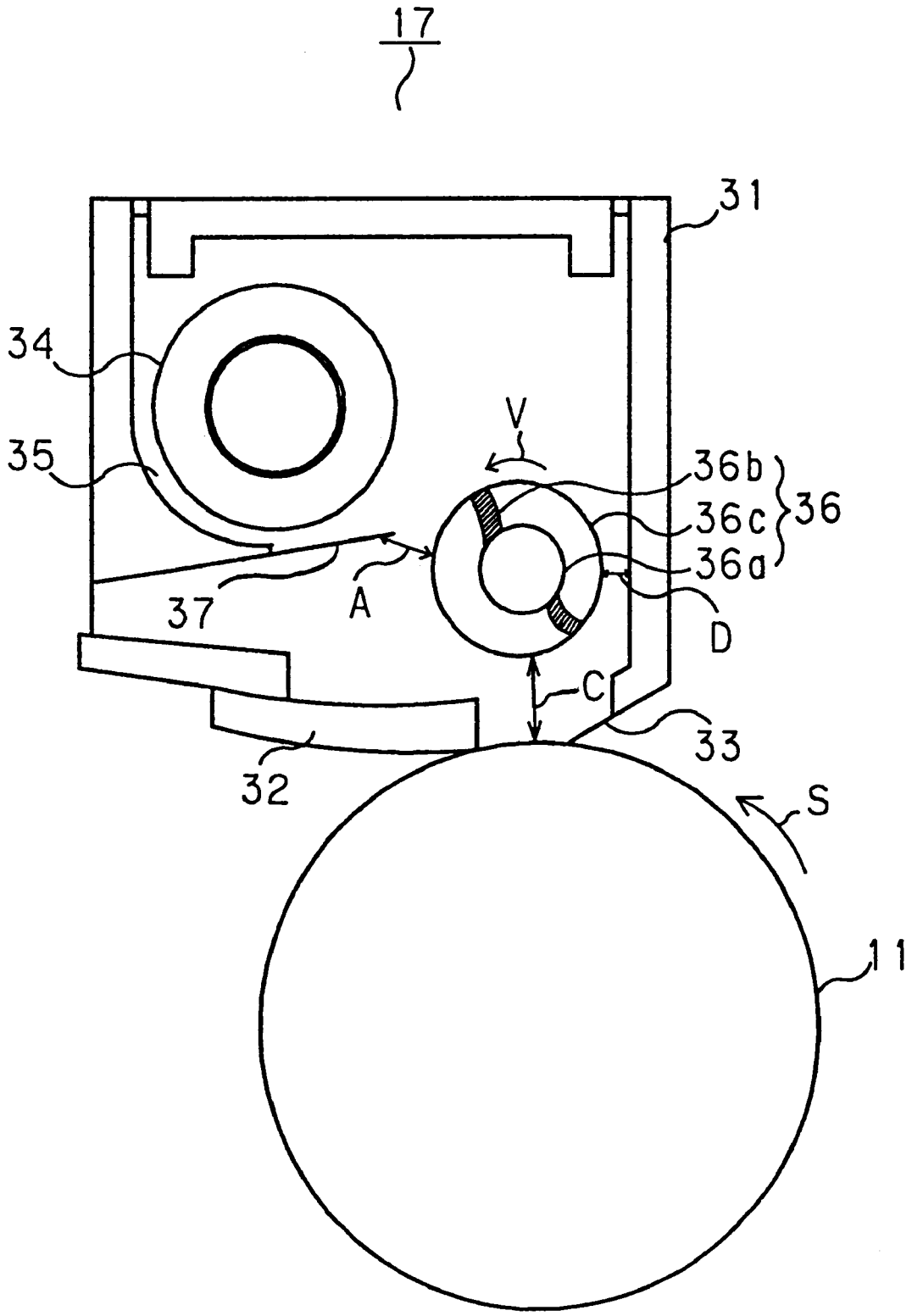
FIG. 3 is a schematic diagram showing the cleaning unit shown in FIG. 2.

Next, the cleaning unit 17 will be described in detail. As shown in FIG. 3, at the positions of a container 31 of the cleaning unit 17 facing the photosensitive drum 11, a cleaning blade 32 is provided as a developer removing means to scrape off magnetic residual toner left on the photosensitive drum 11 after passing the transfer charger 16*a* and further, a recovery blade 33 is provided.

Further, in the container 31, a recovery auger 34 is provided to convey waste toner that is residual toner scraped off from the photosensitive drum 11 with the cleaning blade 32 to a recovery box which is not shown.

Further, there is provided a magnetic developer carry-out roller 36 in 12 mm diameter that is a developer carry-out means for conveying the waste toner scraped by the cleaning blade 32 and accumulated at a position facing the photosensitive drum 11 between the cleaning blade 32 and the recovery blade 33 to the recovery position facing the recovery auger 34, in enclosed space from the cleaning blade 32 in the container 31 to the recovery auger 34.

The developer carry-out roller 36 comprises a shaft 36*a* attached with magnets 36*b* in the feather shape covered by a non-magnetic material made hollow cylinder 36*c*.

At the recovery position around the developer carry-out roller 36, there is arranged a film shaped waste toner peeling member 37 that is made of mylar and to be attached to the bottom of an exhaust path 35 of the recovery auger 34. The waste toner peeling member 37 peels off waste toner attached to the surface of the developer carry-out roller and supplies to the recovery auger 34.

Next, the arrangement of the developer carry-out roller 36 and the waste toner peeling member 37 in the cleaning unit 17 will be described in detail. The waste toner peeling member 37 and the developer carry-out roller 36 are kept separated with a gap and not in contact with each other in the container 31.

When the gap between the waste toner peeling member 37 and the developer carry-out roller 36 is taken as "Distance A", in order to peel off waste toner from the developer carry-out roller 36, this "Distance A" must be less than the thickness of a waste toner layer formed on the developer carry-out roller 36. Accordingly, "Distance A" should be less than the minimum layer thickness of waste toner on the surface of the developer carry-out roller 36 that is controlled until it is conveyed to the position of the waste toner peeling member 37 after scraped off by the cleaning blade 32. That is, when the minimum layer thickness of waste toner to be controlled on the surface of the developer carry-out roller 36 is assumed to be "Distance B", "Distance A" must always be less than "Distance B" (Distance A<Distance B).

In FIG. 3, the thickness of the waste toner layer on the surface of the developer carry-out roller 36 is controlled by "Distance C", that is a gap between the photosensitive drum 11 and the developer carry-out roller 36 and "Distance D", that is a gap between the inner wall of the container 31 and the developer carry-out roller 36 at the scraping position of the cleaning blade 32. Therefore, in FIG. 3, "Distance B" is equivalent to a smaller distance of either "Distance C" or "Distance D".

Figure 4:
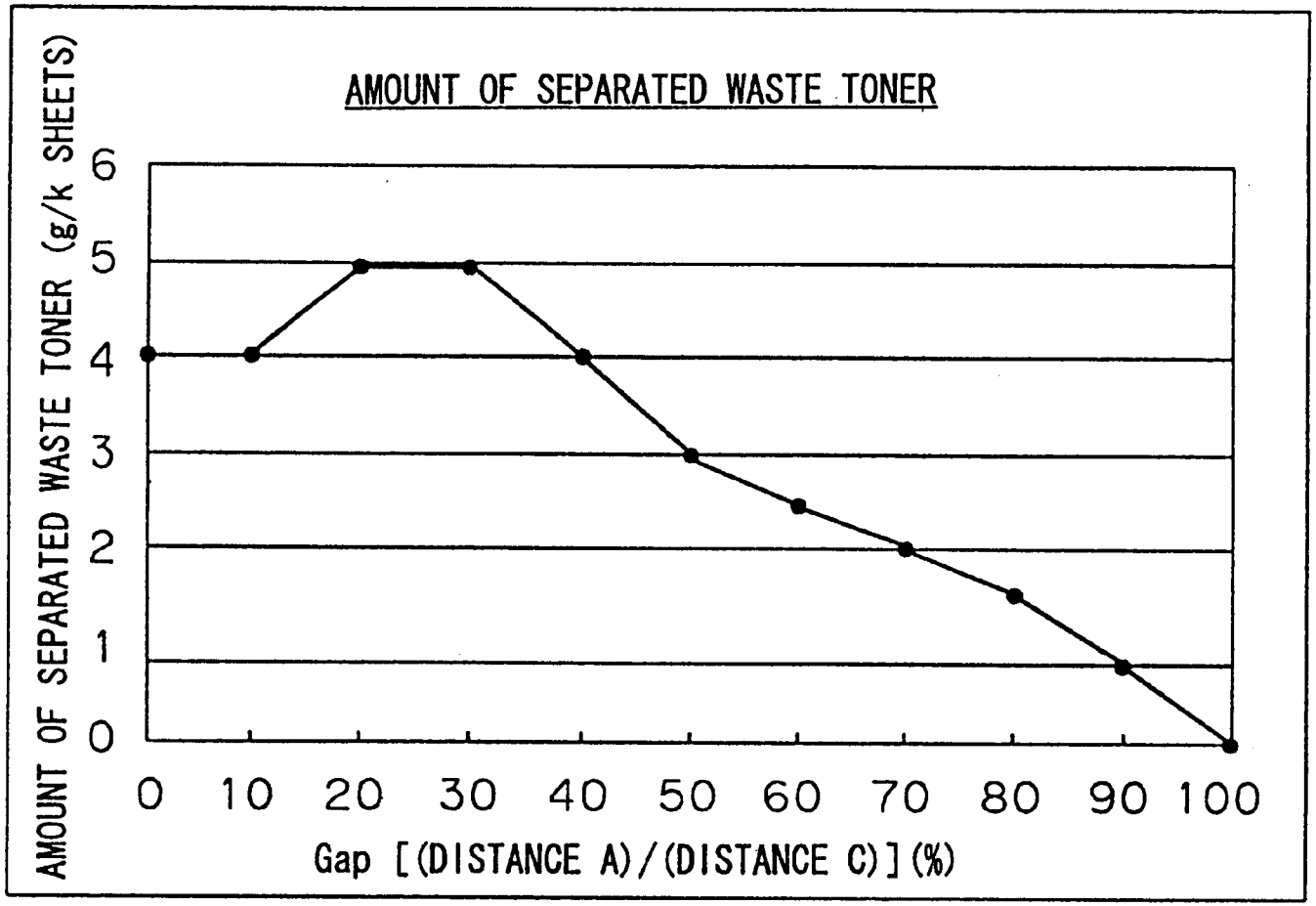
FIG. 4 is a diagram showing the relation between a ratio of "Distance A" that is a gap between separated waste toner and a developer carry-out roller against "Distance C" between the cleaning blade and the photosensitive drum shown in FIG. 3 and amount of separated waste toner.

Further, when the relation between the ratio of "Distance A" to "Distance C" and the waste toner peeling amount by the waste toner peeling member 37 was investigated and the results shown in FIG. 4 were obtained.

Normally, amount of waster toner peeled by the waste toner peeling member 37 from the surface of the developer carry-out roller 36 increases with the decrease in "Distance A". Actually, however, when "Distance A" exceeds a certain degree and becomes too narrow, amount of peeled waste toner will decrease conversely.

This is attributable to a phenomenon that the waste toner scraped off from the photosensitive drum 11 by the cleaning blade 32 and accumulated in the region of "Distance C" between the cleaning blade 32 and the photosensitive drum 11 is pulled by the thin layer of waste toner in a certain thickness left on the surface of the developer carry-out roller 36 and therefore, the waste toner is conveyed more efficiently than a case wherein no waste toner is left on the developer carry-out roller 36.

In other words, when "Distance A" is narrowed, amount of waste toner peeled off from the developer carry-out roller 36 by the waste toner peeling member 37 can be increased but amount of waste toner conveyed by the developer carry-out roller 36; that is, amount of waste toner recovered from "Distance C" decreases and a whole amount of toner decreases. On the contrary, when a certain degree of "Distance A" is maintained, amount of waste toner peeled off from the developer carry-out roller 36 by the waste toner peeling member 37 decreases but amount of waste toner conveyed by the developer carry-out roller 36 increases and a whole amount of waste toner conveyed increases.

From the above-mentioned relation, in order to get the good cleaning property by increasing a total amount of toner peeled off by increasing a conveying amount of waste toner, the range of "Distance A" shown in FIG. 4 is regarded to be proper as shown below:

$$[(\text{Distance } A)/(\text{Distance } C)]\% = 20\text{–}30\%$$

Further, in FIG. 3, actual "Distance A" is 1.25 mm, "Distance C" is 5 mm, and "Distance D" is 5 mm.

When the image formation is started, in the image forming unit 10, a toner image is formed by a magnetic toner on the photosensitive drum 11 through the electrifying charger 12, the exposing unit 13 and the developing device 14 according to the rotation of the photosensitive drum 11 in the arrow direction "s".

On the other hand, when an image receiving medium fed from the paper feeding unit is supplied to the position of the transfer charger 16*a* in synchronism with a toner image on the photosensitive drum 11, a toner image on the photosensitive drum 11 is transferred onto the image receiving medium by the transfer charger 16*a*. Then, the image receiving medium is peeled off from the photosensitive drum 11 by the peeling charger 16*b* and thereafter, the image is fixed through the fixing processing.

Further, after completing the transfer of the image, the photosensitive drum 11 reaches the cleaning unit 17, where residual toner is removed, the charge is eliminated by the charge eliminating lamp 18, and next image forming is enabled.

When removing residual toner on the photosensitive drum 11, the cleaning unit 17 scrapes off residual toner left on the photosensitive drum 11 with the cleaning blade 32 after completing the image transfer. Further, the cleaning unit 17 carries out waste toner scraped with the cleaning blade 32 and accumulated between the recovery blade by adsorbing it magnetically on the surface of the developer carry-out roller 36 that rotates in the arrow direction "v" toward the recovery auger 34.

Thereafter, waste toner is peeled off from the surface of the developer carry-out roller 36 with the waste toner peeling member 37 and fed to the recovery auger 34. After peeling waste toner by the waste toner peeling member 37, a thin layer of waste toner in the thickness of "Distance A" is formed on the surface of the developer carry-out roller 36. When the developer carry-out roller 36 holding the thin layer of waste toner in the thickness of "Distance A" on its surface reaches the position of the cleaning blade 32, the conveying amount of waste toner in the direction of the recovery auger 34 is increased by efficiently adsorbing accumulated water toner by the magnetic force of the waster toner thin layer in the thickness of "Distance A".

Thus, when waste toner adsorbed on the surface of the developer carry-out roller 36 and conveyed is peeled off with the waste toner peeling member 37 through the gap of "Distance A", the conveying amount of waste toner by the developer carry-out roller 36 can be increased. Accordingly, the peeling amount of waste toner by the waste toner peeling member 37 can be increased, the more satisfactory cleaning property is obtained and an image of good quality is obtained.

Further, because the waste toner peeling member 37 is not in contact with the surface of the developer carry-out roller 36, neither sliding contact sound nor vibration is produced between the developer carry-out roller 36 and the waste toner peeling member 37 during the cleaning and therefore, it is possible to maintain the surrounding environment of a place wherein the image forming apparatus is installed in the calm and good state.

Further, because the waste toner peeling member 37 is not in contact with the surface of the developer carry-out roller 36, the wear of the waste toner peeling member 37 is prevented, waste toner can be certainly fed up to the life end of the recovery auger 34 and a high cleaning performance can be maintained for an extended period.

The present invention is not restricted to the above-mentioned embodiment but can be variously modified within the scope of the present invention. For instance, in the above-mentioned embodiment, "Distance A", that is a gap between the developer carry-out means and the peeling means can be within a range wherein peeling amount of waste toner can be increased with the peeling means and to increase peeling amount of waste toner more effectively, "Distance A" can be within the range of 20–30% of "Distance C", that is a gap between the developer carry-out means and the image carrier. Further, for instance, the peeling means can be made by resin, etc.

As described above in detail, according to the present invention, waste toner is peeled off with the peeling means provided through a gap in the state leaving a thin layer of waste toner in the thickness equivalent to the gap. Therefore, according to the present invention, as a result of effects of increased conveying amount of waste toner with the developer carry-out means and increased peeling amount of waste toner with the peeling means, more good cleaning property and an image of good quality are obtained. Further, according to the present invention, as the peeling means and the developer carry-out means are not in contact with each other, noise and vibration during the cleaning can be prevented and the surrounding environment wherein the image forming apparatus is installed can be held in the calm and good state. Further, the abrasion of the peeling means can be prevented, waste toner can be peeled and recovered certainly at the recovery position up to the life end of the cleaner and the satisfactory cleaning proper can be obtained for an extended period

What is claimed is:

1. An image forming apparatus comprising:

image forming means for forming a developer image on an image carrier using magnetic developer;

transferring means for transferring the developer image formed on the image carrier onto an image receiving medium; and cleaning means for scraping residual toner left on the image carrier into a container by a developer removing means after passing the transferring means, for conveying the scraped residual toner to the residual toner recovery position from the position facing the image carrier in the container by a developer carry-out means comprising a roller shaped magnetic member, and for peeling off the residual toner from the surface of the image carry-out means by a peeling means opposing to the developer carry-out means at the recovery position through a gap leaving a thin layer of the magnetic developer.

2. The image forming apparatus according to claim 1, wherein the image forming means includes:

charging means for charging the surface of the image carrier to a prescribed potential by giving electric charge to the surface of the image carrier;

latent image forming means for forming an electrostatic latent image on the surface of the image carrier that is charged to a prescribed potential; and developing means for forming a developer image by feeding the magnetic developer to the electrostatic latent image formed on the surface of the image carrier.

3. The image forming apparatus according to claim 1, wherein the developer removing means is in the blade shape, the developer carry-out means is a magnet covered by a hollow roller made of non-magnetic material, and the peeling means is in the film shape.

4. The image forming apparatus according to claim 1, wherein "Distance A", that is a gap between the peeling means and the developer carry-out means, is less than "Distance B", that is the minimum layer thickness controlled on the developer carry-out means while the residual developer conveyed by the developer carry-out means reaches the residual developer recovery position from the opposing position to the image carrier.

5. The image forming apparatus according to claim 4, wherein the "Distance A" is a distance of 20–30% of "Distance C", the gap between the developer carry-out means and the image carrier.

6. An image forming apparatus comprising:

a charging device configured to charge the surface of a photosensitive drum to a prescribed potential;

an exposer device configured to expose and scan the surface of the photosensitive drum charged to the prescribed potential and form an electrostatic latent image thereon;

a developing device to configured to form a developer image by feeding a magnetic developer to the electrostatic latent image formed on the surface of the photosensitive drum;

a transferring device configured to transfer the developer image formed on the photosensitive drum onto an image receiving medium; and a cleaner device configured to scrape off residual developer left on the photosensitive drum in a container by a cleaning blade after passing the transferring device conveying the scraped residual developer to the residual developer recovery position from the position facing the photosensitive drum in the container by a magnetic developer carry-out roller, and peeling off the residual developer from the surface of the developer carry-out roller by a peeling member opposing to the developer carry-out roller through a gap at the recovery position leaving a thin layer of the magnetic developer.

7. The image forming apparatus according to claim 6, wherein the developer carry-out roller has magnets covered with a hollow roller made of non-magnetic material, and further, the peeling member is in the film shape.

8. The image forming apparatus according to claim 6, wherein "Distance A", that is a gap between the peeling member and the developer carry-out roller is less than "Distance B", that is the minimum layer thickness controlled on the developer carry-out roller while the residual developer conveyed by the developer carry-out roller reaches the residual developer recovery position from the position facing the photosensitive drum.

9. The image forming apparatus according to claim 8, wherein the "Distance A" is a distance of 20–30% of the "Distance C" that is a gap between the developer carry-out roller and the photosensitive drum.

10. A developer recovery method in an image forming apparatus, comprising the steps of:

a charging step for charging the surface of the image carrier to a prescribed potential;

an exposing step for exposing and scanning the charged surface of the image carrier and forming an electrostatic latent image;

a developing step for forming a developer image by feeding a magnetic developer to the electrostatic latent image formed on the surface of the image carrier;

a transferring step for transferring the developer image formed on the image carrier on an image receiving medium;

a scraping step for scraping residual developer left on the image carrier in a container after the transferring step is completed;

a conveying step for conveying the residual developer scraped in the container to the residual developer recovery position from the position facing the image carrier by the magnetic developer carry-out roller in the container; and a peeling step for peeling the residual developer from the surface of the developer carry-out roller by a peeling means facing the developer carry-out roller through a gap at the recovery position leaving the thin layer of the magnetic developer.

11. The developer recovery method in the image forming method according to claim 10, wherein the magnetic action of the thin film of the magnetic developer left on the surface of the developer carry-out roller contributes to the conveyance of the residual developer by the developer carry-out roller in the conveying step.

12. The developer recovery method in the image forming apparatus according to claim 10, wherein the "Distance A", that is a gap between the peeling means and the developer carry-out roller, is made less than the "Distance B, that is the minimum layer thickness controlled on the developer carry-out roller, while the residual developer conveyed by the developer carry-out roller reaches the residual developer recovery position from the position facing the image carrier and the thin layer of the magnetic developer is left on the surface of the developer carry-out roller.

13. The developer recovery method in the image forming apparatus according to claim 12, wherein the "Distance A" is made to a distance of 20–30% of the "Distance C", that is a gap between the developer carry-out roller and the image carrier.

* * * * *